US010851753B2

(12) United States Patent
Mawhinney et al.

(10) Patent No.: US 10,851,753 B2
(45) Date of Patent: Dec. 1, 2020

(54) FUEL INJECTOR, A FUEL INJECTOR ASSEMBLY AND AN ASSOCIATED METHOD

(71) Applicant: Caterpillar Inc., Peoria, IL (US)

(72) Inventors: Graeme Mawhinney, Belfast (GB); Alan R. Stockner, Metamora, IL (US); Paul Stark, Peoria, IL (US); David Mack, Summerfield, FL (US)

(73) Assignee: Caterpillar Inc., Peoria, IL (US)

( * ) Notice: Subject to any disclaimer, the term of this patent is extended or adjusted under 35 U.S.C. 154(b) by 249 days.

(21) Appl. No.: 15/335,066

(22) Filed: Oct. 26, 2016

(65) Prior Publication Data

US 2017/0122280 A1 May 4, 2017

(51) Int. Cl.
*F02M 65/00* (2006.01)
*F02M 61/02* (2006.01)

(52) U.S. Cl.
CPC ..... *F02M 65/008* (2013.01); *F02M 61/02* (2013.01)

(58) Field of Classification Search
CPC ..... F02M 65/008; F02M 61/02; F02M 61/04; F02M 63/0017; F02M 65/007; F02M 2200/46; F02B 77/04; F02B 2077/045
USPC ..... 239/88–92, 5, 553.2–533.12, 583–586
See application file for complete search history.

(56) References Cited

U.S. PATENT DOCUMENTS 4,465,237 A 8/1984 Kupper
4,856,713 A * 8/1989 Burnett ..... F02M 43/04 123/23
5,339,845 A 8/1994 Huddas
6,047,671 A 4/2000 Tubb et al.
6,234,002 B1 * 5/2001 Sisney ..... F02M 65/001 134/166 R
2002/0056761 A1 * 5/2002 Boecking ..... F02M 45/12 239/88
2006/0060673 A1 * 3/2006 Mack ..... F02M 45/086 239/533.2

(Continued)

FOREIGN PATENT DOCUMENTS

DE 112011105459 4/2014
EP 0064146 11/1982

(Continued)

OTHER PUBLICATIONS

Search Report for related GB Application No. 1519224.8; report dated Apr. 12, 2016.

*Primary Examiner* — Alex M Valvis

(57) ABSTRACT

A fuel injector is provided which has a valve member, a valve member guide and a spring chamber. Discharge of fuel out of a fuel injector outlet is controlled by movement of the valve member within a bore of the valve member guide. The spring chamber contains a biasing member, which is a compression spring, and which biases the valve member into contact with a valve seat when in a closed configuration. The fuel supply passage is provided, which by-passes the spring chamber, to direct a flow of the fuel to an outlet chamber of the fuel injector, and the cleaning fluid supply passage is provided to supply a pressurized cleaning fluid to a second end of the bore to restrict leakage of the fuel from the outlet chamber towards the second end of the bore along a clearance extending between the valve member and the valve member guide.

14 Claims, 7 Drawing Sheets

(56) References Cited

U.S. PATENT DOCUMENTS

| | | | | |
|---|---|---|---|---|
| 2006/0213485 | A1* | 9/2006 | Balling | F02M 47/027 123/461 |
| 2008/0295492 | A1* | 12/2008 | Karkkainen | F01N 3/025 60/286 |
| 2011/0220150 | A1* | 9/2011 | Villa | B08B 1/04 134/22.1 |
| 2012/0055514 | A1* | 3/2012 | Vince | F02M 65/008 134/22.18 |
| 2014/0239090 | A1* | 8/2014 | Minami | F02M 47/027 239/113 |

FOREIGN PATENT DOCUMENTS

| | | | |
|---|---|---|---|
| EP | 1258628 | A1 | 11/2002 |
| GB | 2051234 | A | 5/1980 |
| GB | 2543826 | B | 7/2019 |
| JP | 2008121545 | | 5/2008 |
| WO | WO-00/63552 | | 10/2000 |
| WO | WO-2008/000095 | A1 | 1/2008 |
| WO | WO-2014/007501 | A1 | 1/2014 |

* cited by examiner

FUEL INJECTOR, A FUEL INJECTOR ASSEMBLY AND AN ASSOCIATED METHOD

CROSS-REFERENCE TO RELATED APPLICATION

This application claims priority under 35 USC § 119 and the Paris Convention to Great Britain Application No. 1519224.8 filed on Oct. 30, 2015.

TECHNICAL FIELD

The disclosure relates to a fuel injector, a fuel injector assembly and an associated method of operation of the fuel injector assembly.

BACKGROUND

Internal combustion engines may be provided with a fuel injector in each cylinder of the internal combustion engine which operate to provide controlled delivery of fuel for combustion within the cylinder. Fuel injectors can be used for the direct or indirect injection of fuel into either a combustion chamber or an interconnecting pre-combustion chamber or a combustion air ducting of the internal combustion engine. Fuel injectors may be used in both compression ignition (C.I.) and spark ignition (S.I.) engines. Fuel injectors for C.I. engines normally operate at much higher pressures that those for S.I. engines.

A problem with fuel injectors is that they may need to be cleaned periodically to remove combustion products which, if left, might reduce fuel flow and may ultimately lead to blockage of the fuel injector.

EP1258628 describes a fuel injector valve for a S.I. engine comprising a nozzle body in which a valve needle is arranged. The valve needle is in operative connection with a valve closing body which cooperates with a valve seat. Movement of the valve closing body into and out of sealing engagement with the valve seat is controlled by a solenoid arrangement, which when energised lifts off the valve closing body from the valve seat, and a restoring spring, which biases the valve closing body back into engagement with the valve seat when the solenoid arrangement is switched off. Fuel is supplied to discharge orifices of the fuel injector via a central fuel supply conduit and fuel channels which extend in fluid communication with the restoring spring, solenoid arrangement, valve closing body and valve needle. Two auxiliary inlets are provided through which a cleaning additive may be flooded through the fuel injector. A first auxiliary inlet connects to a downstream zone of the fuel injector and a second auxiliary inlet connects to an inlet-side part of the fuel injector such that the cleaning additive can be flooded into the fuel injector to contact the central fuel supply conduit, restoring spring and solenoid arrangement.

Another problem which may occur with fuel injectors is where deposits of the fuel accumulate within the fuel injector. Such deposits may be in the form of a hardened lacquer layer that may build up on surfaces exposed to the fuel. This may particularly be a problem where the fuel is relatively sensitive to heat and liable to polymerization. Such problems are commonly encountered when using biomass derived liquid fuels using various synthesis processes such as raw vegetable oils and fast pyrolysis liquid products. Such deposits may lead to blockage of the fuel injector or other malfunction of its moving components.

Against this background there is provided a fuel injector, a fuel injector assembly and an associated method of operation of the fuel injector assembly, which may find particular application in a C.I. engine.

SUMMARY OF THE DISCLOSURE

The present disclosure provides a fuel injector comprising a valve member, a valve member guide, a spring chamber, a fuel supply passage and a cleaning fluid supply passage;

- the valve member being movable with respect to the valve member guide into and out of contact with a valve seat of the fuel injector to thereby control discharge of a fuel out of a fuel injector outlet;
- the valve member guide defining a bore which receives the valve member, the bore being configured to guide the valve member during sliding movement of the valve member into and out of contact with the valve seat, the bore comprising a first end proximate the fuel injector outlet and a second end distal the fuel injector outlet;
- the spring chamber containing a biasing member which biases the valve member into contact with the valve seat;
- the fuel supply passage being configured to direct a flow of the fuel to an outlet chamber of the fuel injector, the outlet chamber being in fluid communication with the first end of the bore and the valve member; wherein the fuel supply passage by-passes the spring chamber;
- the cleaning fluid supply passage being in fluid communication with the second end of the bore and configured to supply a pressurised cleaning fluid to the second end of the bore to restrict leakage of the fuel from the outlet chamber towards the second end of the bore along a clearance extending between the valve member and the valve member guide.

The present disclosure also provides a fuel injection assembly comprising a fuel injection pump, a cleaning fluid pump and a fuel injector as described above;

- the fuel injection pump comprising a fuel supply conduit in fluid communication with the fuel supply passage of the fuel injector; and
- the cleaning fluid pump comprising a cleaning fluid supply conduit in fluid communication with the cleaning fluid supply passage of the fuel injector.

The present disclosure further provides a method of operating a fuel injection assembly as described above, comprising simultaneously operating the fuel injection pump to supply a pressurised flow of fuel to the outlet chamber of the fuel injector via the fuel supply passage and operating the cleaning fluid pump to supply a pressurised flow of cleaning fluid to the second end of the bore of the fuel injector via the cleaning fluid supply passage.

BRIEF DESCRIPTION OF THE DRAWINGS

The present disclosure will now be described, by way of example only, with reference to the accompanying drawings in which.

DETAILED DESCRIPTION

Figure 1:
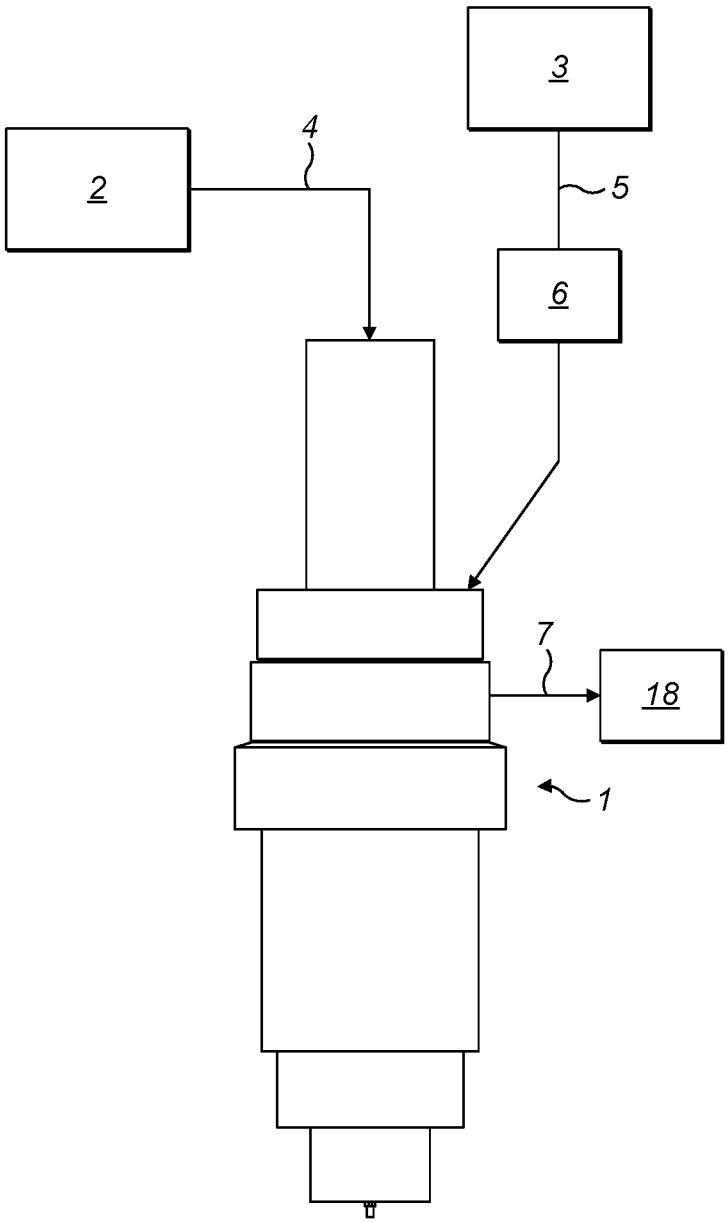
FIG. 1 shows schematically a fuel injection assembly according to the present disclosure.

As illustrated in FIG. 1, a fuel injection assembly according to the present disclosure comprises a fuel injection pump 2, a cleaning fluid pump 3 and a fuel injector 1. The fuel injection assembly may be configured for use with an internal combustion engine, preferably a C.I. engine. The fuel injection pump 2 is connected to the fuel injector 1 by a fuel supply conduit 4. The fuel injection pump 2 may be integrated with the fuel injector 1 as a single component or may be a separate component. The fuel injection pump 2 may be driven off an elliptical cam to produce a cyclical increase and decrease in the pressure of the fuel supplied by the fuel injection pump 2 to the fuel supply conduit 4. The cleaning fluid pump 3 may be connected to the fuel injector 1 via a cleaning fluid sensor 6 by means of a cleaning fluid supply conduit 5. The cleaning fluid pump 3 may be integrated with the fuel injector 1 as a single component or may be a separate component. A fuel leakage conduit 7 may be provided in communication with the fuel injector 1 and the fuel leakage conduit 7 may have a pressure-regulating valve 18 to control flow of fluid therethrough.

Figure 2:
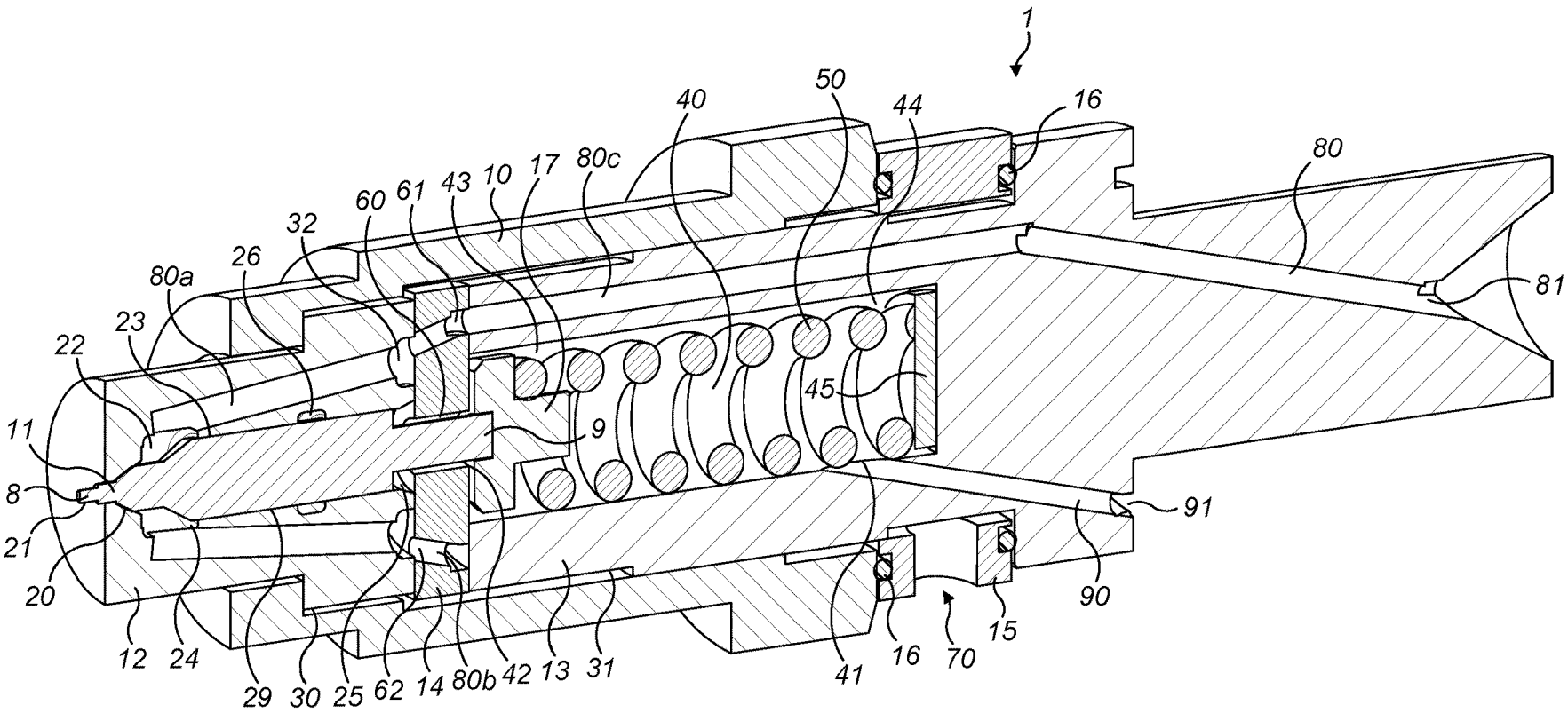
FIG. 2 shows a cross-sectional view of a fuel injector according to the present disclosure.
Figure 3:
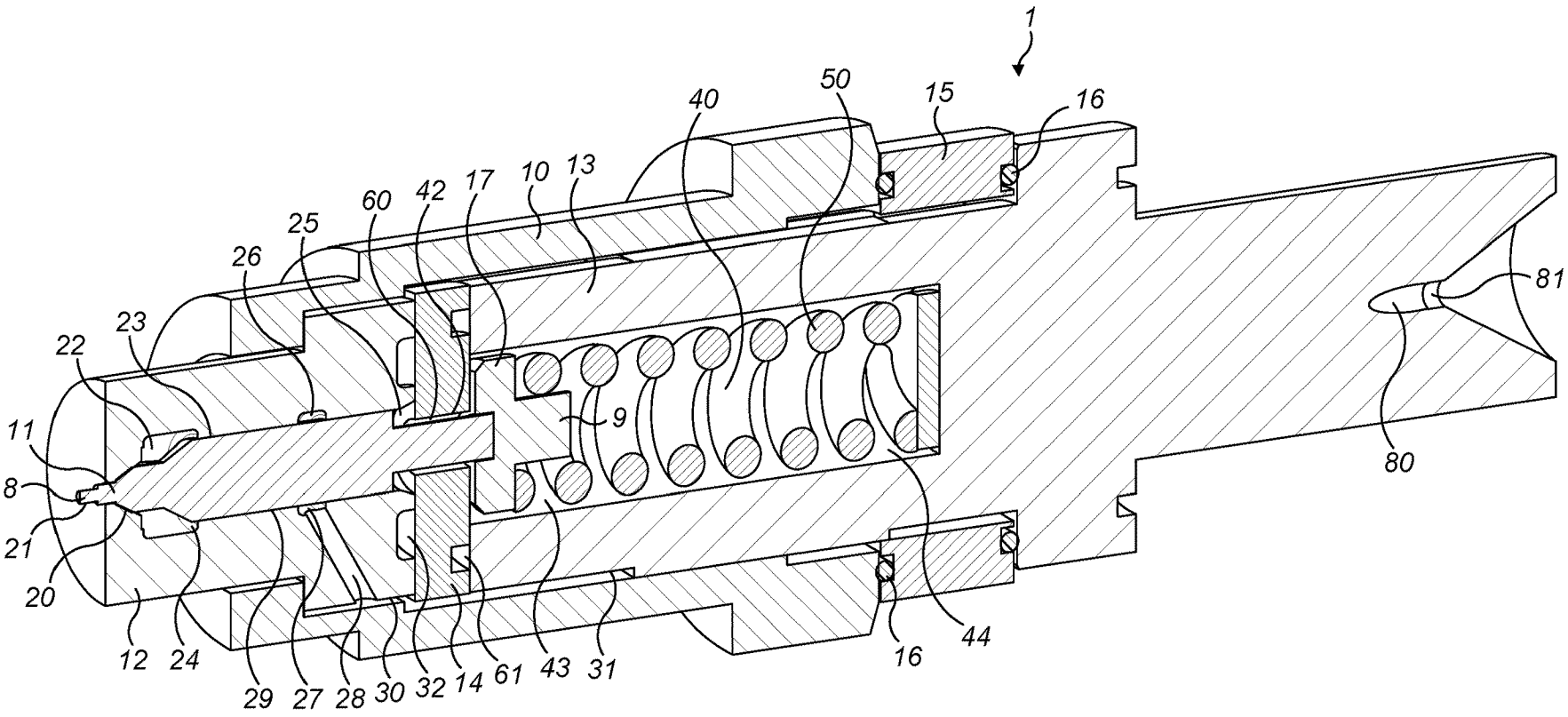
FIG. 3 shows another cross-sectional view of the fuel injector of FIG. 2.

As shown in FIGS. 2 and 3, the fuel injector 1 may comprise a fuel injector body 10 which may house a valve member 11, a valve member guide 12, an intermediate body 14 and a spring chamber housing 13. A collar 15 may also be associated with the fuel injector body 10 as will be described further below. The fuel injector body 10 may be a generally cylindrical component having a stepped diameter and may have a hollow central bore for receiving the valve member guide 12, the intermediate body 14 and the spring chamber housing 13.

Figure 4:
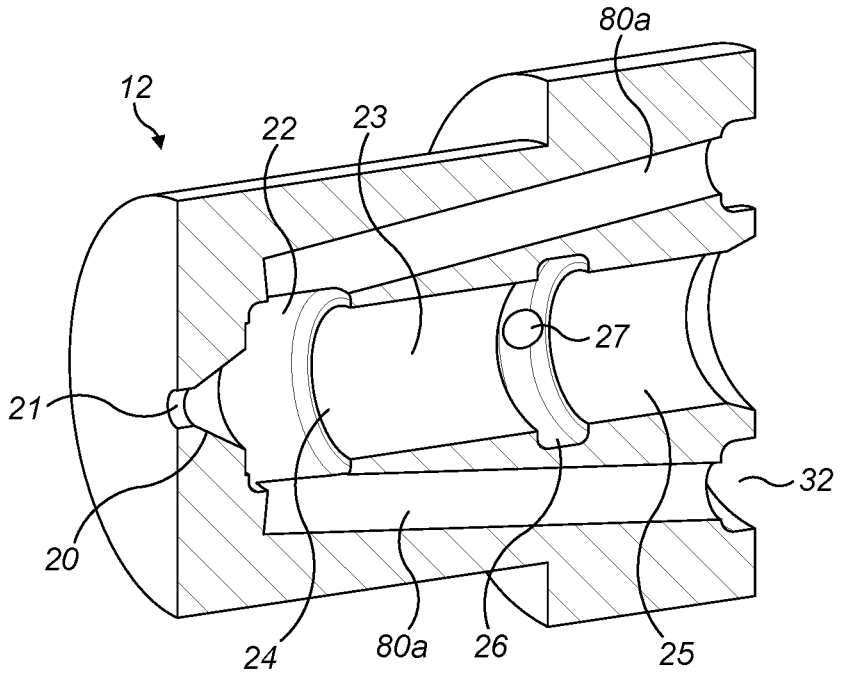
FIG. 4 shows a cross-sectional view of a valve member guide of the fuel injector of FIG. 2.
Figure 5:
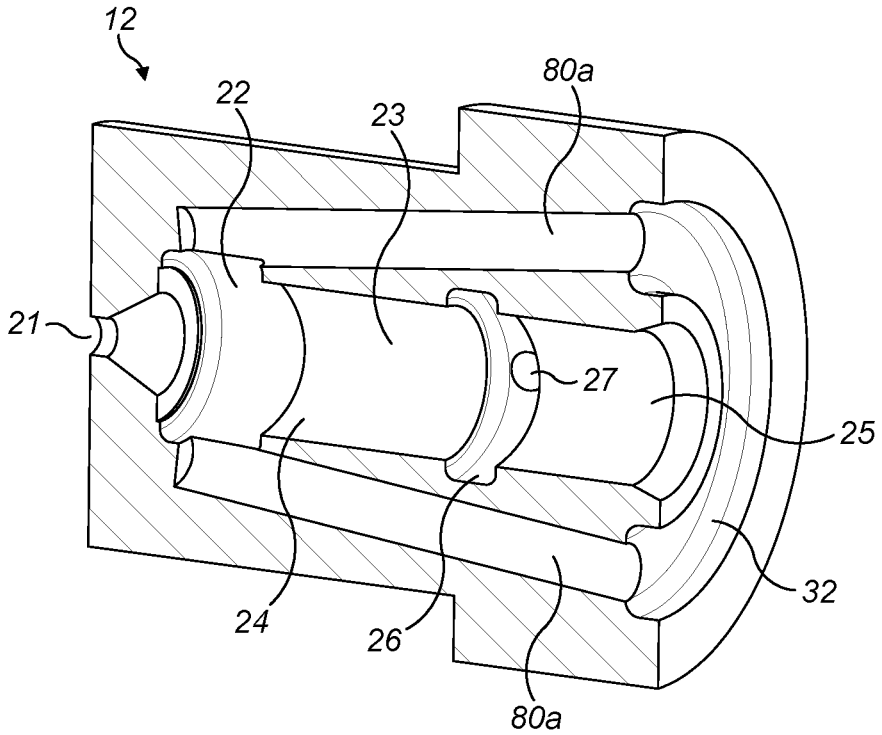
FIG. 5 shows another cross-sectional view of the valve member guide of FIG. 4.
Figure 6:
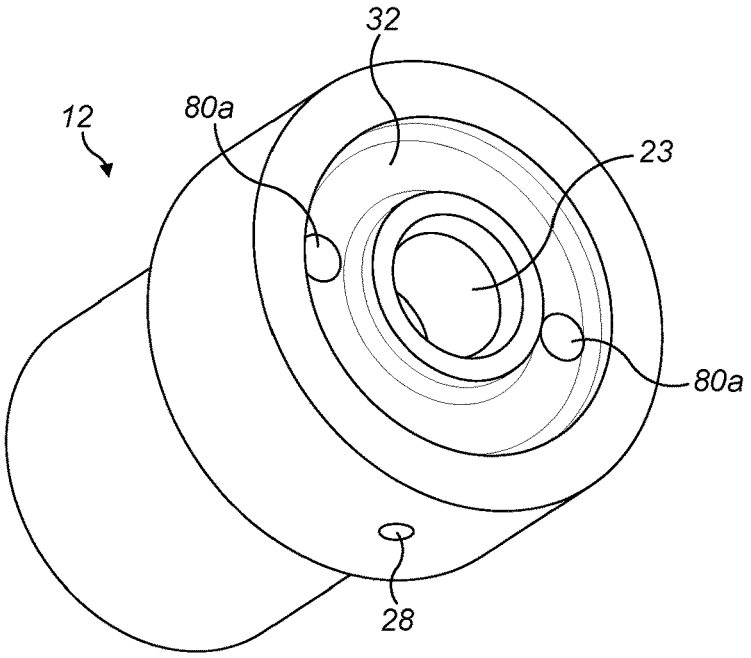
FIG. 6 shows a perspective view of the valve member guide of FIG. 4.

The valve member guide 12 is shown in FIGS. 4 to 6. The valve member guide 12 may be a generally cylindrical component having a stepped diameter with a narrower portion at one end which may terminate in an aperture which may define a fuel injector outlet 21 and a wider portion at an opposite end which may be provided with a first annular fuel gallery 32. The valve member guide 12 defines a bore 23 which may pass along the central axis of the valve member guide 12 from a first end 24 proximate the fuel injector outlet 21 to a second end 25 distal the fuel injector outlet 21.

A fuel supply passage 80 may be provided that passes through an interior of the fuel injector 1 from a fuel inlet port 81 to an outlet chamber 22.

Two inclined passages 80*a*, forming a part of the fuel supply passage 80, may be provided which extend from the first annular fuel gallery 32 to the outlet chamber 22 which may be provided in the region of the fuel injector outlet 21. The outlet chamber 22 is in fluid communication with both the bore 23 and the fuel injector outlet 21. The fuel injector outlet 21 may be surrounded by a valve seat 20 which may be in the form of a conical surface of the valve member guide 12. An annular drainage gallery 26 may be provided in the valve member guide 12 located in between the first end 24 and second end 25 of the bore 23. As shown, the annular drainage gallery 26 may be located approximately midway between the first end 24 and second end 25. The annular drainage gallery 26 may be in the form of an enlarged diameter portion of the bore 23. A drainage port 27 may be provided in the annular drainage gallery 26 which may connect to a drainage passage 28 to provide fluid communication between the annular drainage gallery 26 and an exterior surface of the valve member guide 12 as shown in FIG. 6. The drainage passage 28 is also shown in FIG. 3 and in dashed lines in FIG. 11 where it can be seen that the drainage passage 28 may extend away from the bore 23.

Figure 7:
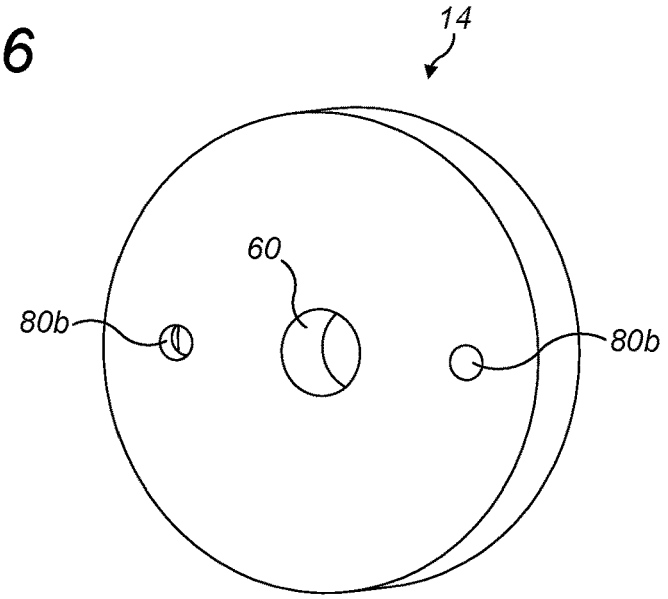
FIG. 7 shows a perspective view of an intermediate body of the fuel injector of FIG. 2.
Figure 8:
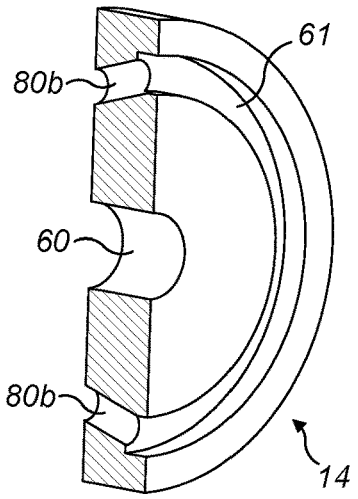
FIG. 8 shows a cross-sectional view of the intermediate body of FIG. 7.

The intermediate body 14 is shown in FIGS. 7 and 8 and may typically comprise a disc-shaped body provided on a face distal the fuel injector outlet 21 with a second annular fuel gallery 61. Two peripheral passages 80*b*, forming a part of the fuel supply passage 80, may be provided which extend through the intermediate body 14 into fluid communication with the second annular fuel gallery 61. The intermediate body 14 may further be provided with a central bore 60 which may pass through the length of the intermediate body 14.

The valve member 11 may comprise a cylindrical elongate body of varying shape and diameter which is sized and shaped to be received as a sliding fit within the bore 23 of the valve member guide 12. The valve member 11 may have a diameter at its largest point of from 4 to 11 mm. A first end 8 of the valve member 11 may be sized and shaped to form a sealing contact with the valve seat 20 of the valve member guide 12. A second end 9 of the valve member 11 may be sized and shaped to pass through the central bore 60 of the intermediate body 14. A spring seat plug 17 may be received over the second end 9 of the valve member 11 as shown in FIGS. 2 and 3.

Figure 9:
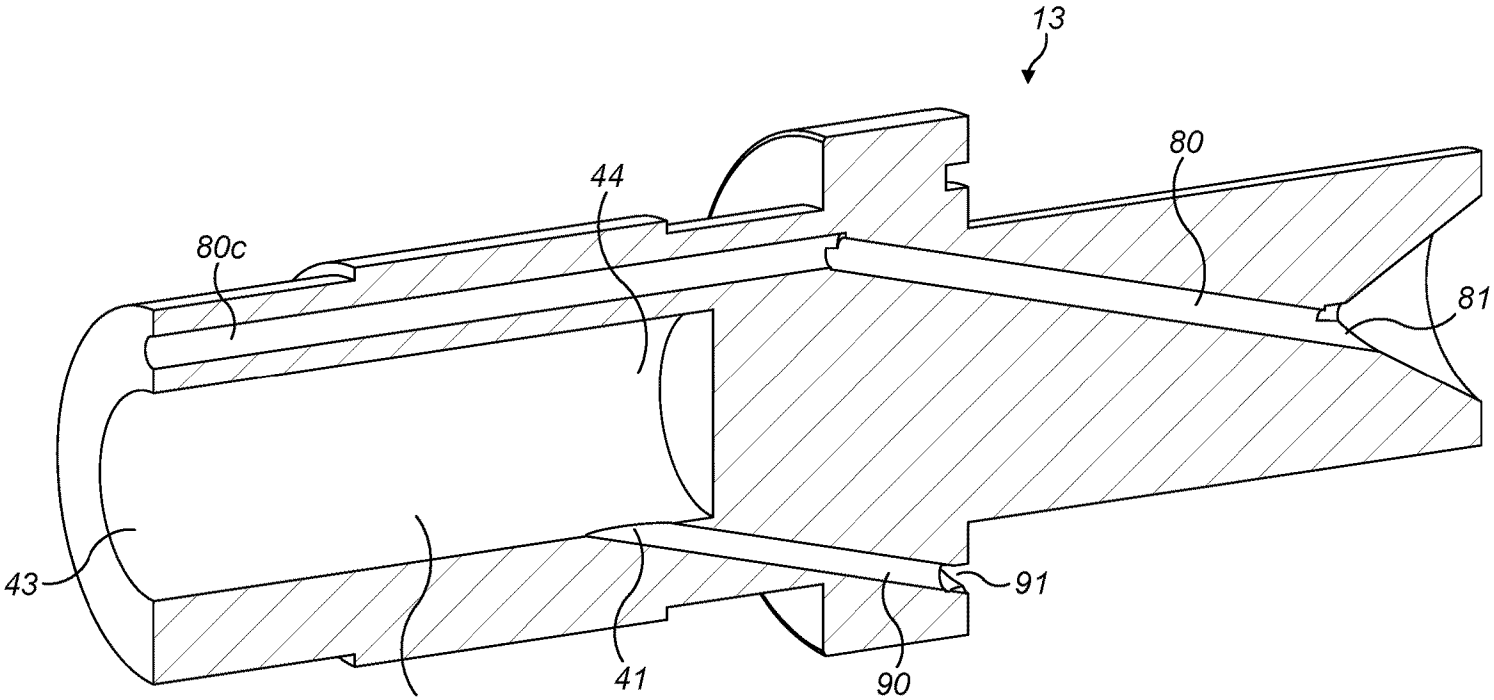
FIG. 9 shows a cross-sectional view of a spring chamber housing of the fuel injector of FIG. 2.

The spring chamber housing 13 is shown in FIG. 9 and may generally comprise a cylindrical body having a stepped diameter having two relatively narrow portions at either end of the spring chamber housing 13 and an enlarged diameter portion approximately mid-way along the length of the spring chamber housing 13. The spring chamber housing 13 may define a spring chamber 40 in which may be contained or have connected thereto a device for producing a biasing force. The biasing force may be, for example, a mechanically-generated force or a hydraulically-generated force. In the case of a mechanically-generated force, this may be produced by a biasing member 50 or similar device. In the example of FIGS. 2 and 3 the biasing member 50 is a compression spring.

The spring chamber 40 may have a first end 43 proximate the fuel injector outlet 21 and a second end 44 distal the fuel injector outlet 21. An entry port 41 may be provided at or near the second end 44 of the spring chamber 40 which communicates with a cleaning fluid inlet port 91 at an exterior of the spring chamber housing 13 via a cleaning fluid supply passage 90 to be able in use to receive pressurised cleaning fluid. In addition, the spring chamber housing 13 may be provided with a dog-leg passage 80*c*, forming a part of the fuel supply passage 80, which extends from the fuel inlet port 81 located at a distal end of the spring chamber housing 13 through the length of the spring chamber housing 13. The dog-leg passage 80*c* may by-pass the spring chamber 40 so that it does not enter or pass through the spring chamber 40. In addition, the dog-leg passage 80*c* may be separate from the cleaning fluid supply passage 90.

Figure 10:
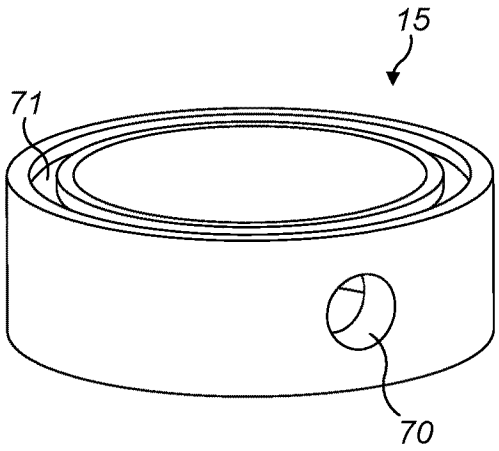
FIG. 10 shows a perspective view of a collar of the fuel injector of FIG. 2.
Figure 11:
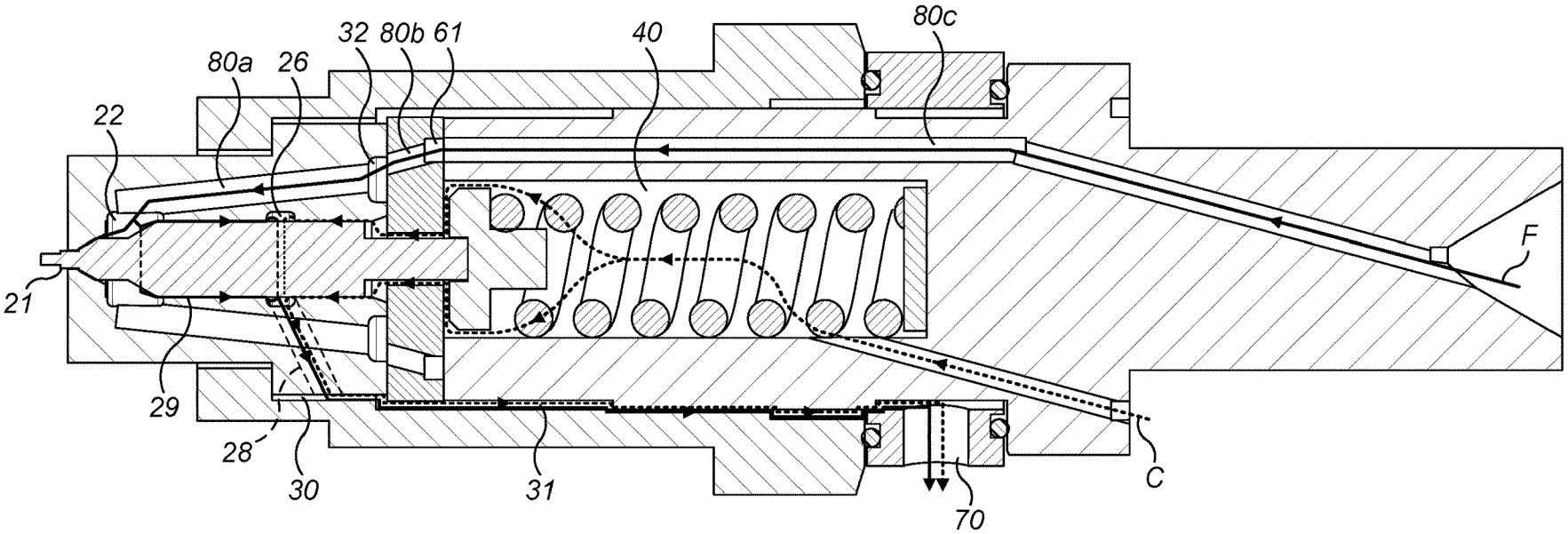
FIG. 11 shows schematically flow paths of a fuel and a cleaning fluid through the fuel injector of FIG. 2.

The collar 15 is shown in FIG. 10 and typically may comprise a cylindrical member having annular recesses 71 on each face and a drain exit port 70 which may be in the form of a through aperture passing through the wall of the collar 15 as shown in FIGS. 10 and 11.

When assembled and in a closed configuration, as shown in FIGS. 2 and 3, the valve member guide 12, intermediate body 14 and spring chamber housing 13 may be stacked in longitudinal arrangement and retained within the fuel injector body 10. The surfaces of the valve member guide 12, intermediate body 14 and spring chamber housing 13 which interface with each other by way of contact may have a polished metal finish creating a fluid-tight seal therebetween. A first annular clearance 30 may be provided between an inner surface of the fuel injector body 10 and an outer surface of the valve member guide 12 as shown in FIG. 2. In addition, a second annular clearance 31 may be provided between the inner surface of the fuel injector body 10 and an outer surface of the spring chamber housing 13.

When assembled and in the closed configuration the valve member 11 is located at least partially within the bore 23 of the valve member guide 12 with its first end 8 extending into contact with the valve seat 20 and its second end 9 passing through the central bore 60 of the intermediate body 14 into the spring chamber 40. The spring seat plug 17, also located within the spring chamber 40 is received on the second end 9 of the valve member 11. The biasing member 50 may be located within the spring chamber 40 extending between the second end 44 of the spring chamber 40 and the spring seat plug 17 located at the first end 43 of the spring chamber 40. In this way the biasing member 50 may bias the valve member 11 into the closed configuration as shown in FIGS. 2 and 3. To enable sliding relative movement of the valve member 11 with respect to the valve member guide 12 the diameter of the bore 23 must be made slightly greater than the diameter of the valve member 11. In this way a clearance 29, which may be an annular clearance, is provided between the valve member 11 and the valve member guide 12. The clearance 29 may be kept small and may be, for example, an annular (diametrical) clearance of a few microns.

The collar 15 may be located between an end of the fuel injector body 10 and the enlarged diameter portion of the spring chamber housing 13. An O-ring 16 may be located in each of the annular recesses 71 of the collar 15 to provide a fluid seal between the collar and respectively the fuel injector body 10 and the spring chamber housing 13.

In use, the fuel injection pump 2 operates to supply pressurised fuel to the fuel inlet port 81. The cleaning fluid pump 3 operates to supply pressurised cleaning fluid to the cleaning fluid inlet port 91. The pressurised cleaning fluid may be supplied to the cleaning fluid inlet port 91 continuously, so that pressurised cleaning fluid is supplied to the fuel injector 1 throughout injection of fuel by the fuel injector 1.

As most clearly shown in FIGS. 2 and 11 both a flow path for fuel and a flow path for cleaning fluid may be provided through the fuel injector 1. In FIG. 11 the flow path of the fuel is designated by reference 'F' and the flow path of the cleaning fluid is shown by reference 'C'. As shown, the flow paths for the fuel F and the cleaning fluid C may combine during their routes through the fuel injector 1.

The flow path for fuel F extends from the fuel inlet port 81 provided in the distal end of the spring chamber housing 13 and passes along the dog-leg passage 80*c* of the spring chamber housing 13 and into the second annular fuel gallery 61 of the intermediate body 14. The second annular fuel gallery 61 ensures fluid communication between the dog-leg passage 80*c* and the spring chamber housing 13 and the two peripheral passages 80*b* in the intermediate body 14 irrespective of the annular orientation of the spring chamber housing 13 relative to the intermediate body 14. The fuel path for fuel F then passes through the two peripheral passages 80*b* into the first annular fuel gallery 32 of the valve member guide 12. Again, the first annular fuel gallery 32 ensures fluid communication between the two peripheral passages 80*b* and the two inclined passages 80*a* within the valve member guide 12 irrespective of the annular orientation of the valve member guide 12 with respect to the intermediate body 14. Thereafter the flow path for fuel F passes along the two inclined passages 80*a* within the valve member guide 12 into the outlet chamber 22 located proximate to the fuel injector outlet 21.

As shown in FIGS. 2 and 11, initially discharge of fuel out of the fuel injector outlet 21 is prevented by the sealing contact between the valve member 11 and the valve seat 20. However, due to pressurization of the fuel within the outlet chamber 22, due to action of the fuel injection pump 2, a point will be reached at which the pressure within the outlet chamber 22 acting on the first end 8 of the valve member 11 will be sufficient to overcome the biasing force of the biasing member 50. The fuel injector 1 may be configured to operate at high pressures such that the pressure in the outlet chamber 22 may reach in excess of 100 bar before the biasing force of the biasing member 50 is overcome. At this point, the valve member 11 will lift off the valve seat 20 by sliding axially within the bore 23 away from the fuel injector outlet 21 which opens the fuel injector outlet 21 allowing discharge of fuel. An interior of the fuel injector 1 may reach in excess of 1000 bar during parts of the operating cycle. Discharge of the fuel leads to a reduction in pressure of the fuel within the outlet chamber 22 resulting in resealing of the valve member 11 against the valve seat 20 under action of the biasing member 50. Thus, in this way, in conjunction with the cyclical increase and decrease in the pressure of the supplied fuel from the fuel injection pump 2, a cyclical opening and shutting of the fuel injector outlet 21 may be achieved.

During operation, fuel in the outlet chamber 22 may leak in between the valve member 11 and the valve member guide 12 along the bore 23 in the clearance 29 which is provided between the valve member 11 and the valve member guide 12, even though the clearance 29 is preferably kept very small. Left unrestricted it may be possible for the fuel to pass along the full length of the bore 23, then through the central bore 60 of the intermediate body 14 and into the spring chamber 40.

According to the present disclosure, this may be prevented by the combined action of the pressurised cleaning fluid which is supplied into the cleaning fluid inlet port 91 and through the cleaning fluid supply passage 90 into the spring chamber 40 and the provision of the annular drainage gallery 26 and drainage port 27. As shown, the pressurised cleaning fluid in the spring chamber 40 is in fluid communication with the central bore 60 of the intermediate body 14 and the second end 25 of the bore 23. Thus, the central bore 60 may act as an exit port from the spring chamber 40 for the pressurised cleaning fluid. By suitable configuration of the pressure of the pressurised cleaning fluid, it may be ensured that any leakage of the fuel along the bore 23 through the clearance 29 does not reach the spring chamber 40. This may be ensured by configuring the pressure of the pressurised cleaning fluid so that there is during operation of the fuel injector 1 a small volumetric flow of pressurised cleaning fluid from the spring chamber 40 into the bore 23.

Thus, the spring chamber 40 may form a part of the cleaning fluid supply passage 90 linking the cleaning fluid inlet port 91 with the bore 23.

In practice, the pressure of the pressurised cleaning fluid may be configured by operation of the cleaning fluid pump 3 to be greater than the pressure of the fuel in the annular drainage gallery 26. Thus, the presence of the pressurised cleaning fluid in the spring chamber 40, and optionally the entry of the pressurised cleaning fluid into the second end 25 of the bore 23, restricts flow of the fuel into the spring chamber 40. By 'restricts' is meant that the amount of fuel reaching the spring chamber 40 is reduced and/or the volumetric flow rate of the fuel into the spring chamber 40 is reduced compared to an arrangement where the pressurised cleaning fluid is not supplied.

In order to accommodate a flow of the pressurised cleaning fluid into the second end 25 of the bore 23, drainage of the pressurised cleaning fluid from the bore 23, may be provided for by the provision of the annular drainage gallery 26, drainage port 27 and drainage passage 28. As can be seen in FIG. 11, the pressurised cleaning fluid passing from the spring chamber 40 into the bore 23 passes along the clearance 29 until it reaches the annular drainage gallery 26. From the annular drainage gallery 26 the pressurised cleaning fluid is then drained through the drainage port 27 and along the drainage passage 28 into the first annular clearance 30 between the fuel injector body 10 and the valve member guide 12. From there it may drain into the second annular clearance 31 between the fuel injector body 10 and the spring chamber housing 13. Finally, the pressurised cleaning fluid may be drained out of the drain exit port 70 of the collar 15 into the fuel leakage conduit 7 which may be coupled to the drain exit port 70. Drainage of the pressurised cleaning fluid from the drain exit port 70 may be passive, i.e. driven by the back-pressure of the pressurised cleaning fluid entering the fuel injector 1 at the cleaning fluid inlet port 91. Preferably the pressurised cleaning fluid is configured, for example by suitable adjustment of its pressure by use of the pressure-regulating valve 18, to prevent any fuel reaching the spring chamber 40 during normal operation of the fuel injector 1 and also may ideally be configured so there is little or no leakage of pressurised cleaning fluid through the annular drainage gallery 26 and the drainage port 27. As will be understood, it may be preferable in this way to ensure that the annular drainage gallery 26 and the clearance 29 between the annular drainage gallery 26 and the second end 25 of the bore 23 are always full of pressurised cleaning fluid (so as to most efficiently restrict passage of fuel towards the spring chamber 40) but to limit or prevent any substantial net flow of pressurised cleaning fluid through the fuel injector 1 (so as to limit wastage of the pressurised cleaning fluid).

In addition, and simultaneously to the flow of the pressurised cleaning fluid, any fuel which may leak from the outlet chamber 22 along the bore 23 upon reaching the annular drainage gallery 26 may be diverted and drained through the drainage port 27, drainage passage 28, first annular clearance 30 and second annular clearance 31 along with the pressurised cleaning fluid. Thus, in this way fuel may be prevented from reaching not only the spring chamber 40 but also the second end 25 of the bore 23.

In this way leakage fuel and pressurised cleaning fluid may be drained from the fuel injector 1 via the fuel leakage conduit 7 and pressure-regulating valve 18. The pressure-regulating valve 18 may be used to create a 'pulsing' reciprocating flow of the pressurised cleaning fluid within the passages of the fuel injector 1. For example, as will be understood, during an operating cycle of the fuel injector 1 the pressure of the fuel in the fuel injector will vary and may reach very high pressures (in excess of 1000 bar) but typically for only a very small proportion of the operating cycle. During such peak pressures any leakage fuel and pressurised cleaning fluid in the clearance 29 may tend to be driven up the clearance 29 towards the spring chamber 40 due to the fact that the pressure of the pressurised cleaning fluid is much less than the peak fuel pressure—e.g. the pressure of the pressurised cleaning fluid may of the order of 10 bar. During a remainder of the operating cycle the pressure of the pressurised cleaning fluid is higher than the fuel pressure and any leakage fuel and pressurised cleaning fluid in the clearance may be driven back along the clearance 29 away from the spring chamber 40. In this way a reciprocating flow of the pressurised cleaning fluid, in particular, may be produced in the clearance 29 which may be particularly effective for cleaning and lubrication of the fuel injector 1 components.

It will be noted that the drainage passage 28 and the flow path to the drain exit port 70 may by-pass the spring chamber 40. In addition, at least a portion of the drainage path may extend along an interface of the fuel injector body 10 and the valve member guide 12 and/or an interface of the fuel injector body 10 and the spring chamber housing 13.

The fuel injected by the fuel injector 1 may be of any type suitable for injection. The fuel may be a fossil fuel or biofuel. Typical examples may include petrol, diesel and biodiesel.

The fuel injector 1 of the present disclosure may find particular application when used with fuels that are relatively sensitive to heat such as biomass derived oils and liquid pyrolysis fuels.

The cleaning fluid may be any suitable agent that is compatible with the materials of the fuel injector 1, and with the fuel, and which may act to break up and remove deposits of the fuel and/or combustion products produced from the fuel. Optionally, the cleaning fluid may also act as a lubricant for components of the fuel injector 1. In one example the cleaning fluid may be a blend of ethanol and castor oil. The blend may comprise, for example, a 50:50 blend of ethanol and castor oil.

The components of the fuel injector 1 may be made of standard materials, for example, the fuel injector body 10, valve member 11, valve member guide 12, intermediate body 14, spring chamber housing 13 and collar 15 may all be formed of tool steel, for example of grade 52-100. The O-rings 16 may be a suitable elastomeric material which is compatible with the fuel and cleaning fluid. However, in a case where the fuel F may be of a more corrosive type those components subject to dynamic wear, for example the valve member 11 and the valve member guide 12, may be made of a more corrosion-resistant material such as stainless steel.

The cleaning fluid sensor 6, as shown in FIG. 1, may be configured to sense a volumetric flow rate or volume of the cleaning fluid conveyed, in use, through the cleaning fluid supply conduit 5.

Operation of the fuel injection assembly may comprise simultaneously operating the fuel injection pump 2 to supply a pressurised flow of fuel to the outlet chamber 22 of the fuel injector 1 via the fuel supply passage 80 and operating the cleaning fluid pump 3 to supply a pressurised flow of cleaning fluid to the second end 25 of the bore 23 of the fuel injector 1 via the cleaning fluid supply passage 90. The pressure of the cleaning fluid at the second end 25 of the bore 23 of the fuel injector 1 may be configured to be sufficient to create a flow of the cleaning fluid between the valve member 11 and valve member guide 12 towards the fuel injector outlet 21 for at least a portion of an operating cycle of the fuel injector 1. In addition, the lift-off pressure for the outlet chamber 22 of the fuel injector 1 at which the valve member 11 will move out of contact with the valve seat 20 may be pre-set to take into account the effect of the pressure of the pressurised flow of cleaning fluid which may always be exposed to the second end 25 of the bore 23. For example, the biasing force supplied by the biasing member 50 may be pre-adjusted by use of a shim 45 located between the biasing member 50 and an end of the spring chamber 40. Thus, the biasing force applied to the valve member 11 may be adjusted by altering the thickness of the shim 45 installed.

The fuel injection assembly may also be operated to maintain a diagnostic check of the state of health of the fuel injector 1. Over time the surfaces of the valve member 11 and the bore 23 may be subject to degradation due to friction and/or corrosive effects of the fuel. This may lead to an increase in the effective cross-sectional area of the clearance 29 between the valve member 11 and the valve member guide 12. An increase in the effective cross-sectional area of the clearance 29 will lead to a reduced resistance to passage of the pressurised cleaning fluid along the bore 23. Thus, the cleaning fluid sensor 6 may be configured to detect a rate and/or volume of flow of cleaning fluid passing through the cleaning fluid supply conduit 5. For a fuel injector 1 in a healthy state a required rate and/or volume of flow of cleaning fluid can be determined by experiment. Thereafter, a suitable control means such as an engine control unit or other controller can be used to monitor and detect any significant increase in the rate and/or volume of flow of cleaning fluid passing the cleaning fluid sensor 6 into the fuel injector 1. A threshold value for the rate and/or volume of flow may be set at which an alert is raised which may trigger a maintenance inspection and/or replacement of the fuel injector 1. Alternatively, the cleaning fluid sensor 6 could be located downstream of the fuel injector 1, e.g. within the fuel leakage conduit 7 or pressure-regulating valve 18.

In this description the fuel injector 1 has been described by way of example only as comprising a valve member 11 that is moved relative to a valve seat 20 by hydraulic build-up of pressure of the fuel accumulating in an outlet chamber 22. However, the present disclosure and claims are not limited in this regard and may also be applicable to fuel injectors provided with other devices or methods for moving the valve member 11, for example the use of a magnetically-driven actuator, for example a solenoid, coupled to the valve member 11, or a method of creating a cyclically-changing pressure differential across the valve member 11.

INDUSTRIAL APPLICATION

The present disclosure provides a fuel injector 1, a fuel injection assembly and methods of operation that may advantageously allow for improved reliability and durability of the fuel injector 1. By means of ensuring that the fuel does not enter the spring chamber 40, e.g. the fuel supply passage 80 by-passes the spring chamber 40, and thus contact the biasing member 50, formation of fuel deposits and/or laquer in the region of the biasing member 50 may be reduced and/or prevented. This may lead to a reduced likelihood of jamming of the fuel injector 1 in use. In addition, the fuel injector 1 and the fuel injection assembly may allow for a beneficial diagnostic check of the state of the fuel injector 1 to be carried out by means of monitoring the volumetric flow rate and/or volume of the pressurised cleaning fluid entering the fuel injector 1. This may allow for improved maintenance by allowing for replacement and/or cleaning of the fuel to be carried out before a failure mode is encountered.

The invention claimed is:

1. A fuel injector comprising a valve member, a valve member guide, a spring chamber, a fuel supply passage and a cleaning fluid supply passage;

the valve member being movable with respect to the valve member guide into and out of contact with a valve seat of the fuel injector to thereby control discharge of a fuel out of a fuel injector outlet;

the valve member guide defining a bore which receives the valve member, the bore being configured to guide the valve member during sliding movement of the valve member into and out of contact with the valve seat, the bore comprising a first end proximate the fuel injector outlet and a second end distal the fuel injector outlet with the bore and a portion of an outer surface of the valve member disposed between the first end and the second end of the bore defining a clearance distance between the valve member and the valve member guide, and the valve member guide defining a drainage passage extending from the bore to an outer surface of the valve member guide and intersecting the bore at a drainage port located between the first end and the second end of the bore, wherein the valve member guide comprises an annular drainage gallery defined in the bore and intersected by the drainage passage at the drainage port;

the spring chamber containing a biasing member which biases the valve member into contact with the valve seat, the spring member being in fluid communication with the second end of the bore;

the fuel supply passage being configured to direct a flow of the fuel at a first pressure to an outlet chamber of the fuel injector, the outlet chamber being in fluid communication with the first end of the bore and the valve member; wherein the fuel supply passage by-passes the spring chamber; and the cleaning fluid supply passage being in fluid communication with the spring chamber and configured to supply a pressurised cleaning fluid at a second pressure greater than the first pressure to the second end of the bore to restrict leakage of the fuel from the outlet chamber towards the second end of the bore along the clearance, and configured to simultaneously supply the pressurised cleaning fluid when the fuel supply passage is directing the flow of fuel to the outlet chamber.

2. The fuel injector as claimed in claim 1, wherein pressurization of the fuel within the outlet chamber enables sliding movement of the valve member away from the fuel injector outlet to thereby lift off the valve member from the valve seat to allow discharge of fuel from the outlet chamber out of the fuel injector outlet.

3. The fuel injector as claimed in claim 1, wherein the biasing member is a spring, or a magnetically-driven actuator.

4. The fuel injector as claimed in claim 1, wherein the spring chamber forms a part of the cleaning fluid supply passage.

5. The fuel injector as claimed in claim 4, wherein the spring chamber comprises an entry port to receive pressurised cleaning fluid and an exit port in fluid communication with the second end of the bore, wherein the exit port is located at a first end of the spring chamber proximate the fuel injector outlet and the entry port is located at a second end of the spring chamber distal the fuel injector outlet.

6. The fuel injector as claimed in claim 1, wherein the drainage passage by-passes the spring chamber.

7. The fuel injector as claimed in claim 1, further comprising a fuel injector body which retains the valve member guide, wherein at least a portion of a drainage path extends along an interface of the fuel injector body and the valve member guide.

8. The fuel injector as claimed in claim 7, wherein at least a portion of the drainage path extends along an interface of the fuel injector body and a housing of the spring chamber.

9. A fuel injection assembly comprising a fuel injection pump, a cleaning fluid pump and a fuel injector as claimed in claim 1;

the fuel injection pump comprising a fuel supply conduit in fluid communication with the fuel supply passage of the fuel injector; and the cleaning fluid pump comprising a cleaning fluid supply conduit in fluid communication with the cleaning fluid supply passage of the fuel injector.

10. The fuel injection assembly of claim 9, further comprising a cleaning fluid sensor configured to sense a volumetric flow rate or volume of a cleaning fluid conveyed, in use, through the cleaning fluid supply conduit.

11. The fuel injection assembly of claim 9, wherein the fuel injection pump supplies a pressurised flow of fuel to the outlet chamber of the fuel injector via the fuel supply passage and the cleaning fluid pump supplies a pressurised flow of cleaning fluid to the second end of the bore of the fuel injector via the cleaning fluid supply passage.

12. The fuel injection assembly of claim 11 wherein the cleaning fluid at the second end of the bore of the fuel injector creates a flow of the cleaning fluid between the valve member and the valve member guide towards the fuel injector outlet.

13. The fuel injection assembly of claim 11, wherein the biasing force supplied by the biasing member of the fuel injector and the pressurised flow of cleaning fluid set a lift-off pressure for the outlet chamber of the fuel injector at which the valve member is moved out of contact with the valve seat.

14. The fuel injection assembly of claim 11, wherein a spring seat plug is located within a spring chamber and is received on a second end of the valve member.

* * * * *